United States Patent [19]

Lester

[11] 4,133,161

[45] Jan. 9, 1979

[54] PANEL ASSEMBLIES AND METHODS OF FORMING SAME

[76] Inventor: Allan G. Lester, P.O. Box 23011, Joubert Park, Johannesburg 2001, South Africa

[21] Appl. No.: 790,570

[22] Filed: Apr. 25, 1977

Related U.S. Application Data

[63] Continuation-in-part of Ser. No. 677,984, Apr. 19, 1976.

[30] Foreign Application Priority Data

| | | | |
|---|---|---|---|
| May 1, 1975 | [ZA] | South Africa | 75/2818 |
| May 25, 1976 | [ZA] | South Africa | 76/3111 |
| Jun. 30, 1976 | [ZA] | South Africa | 76/3911 |
| Apr. 30, 1976 | [ZA] | South Africa | 76/37 |

[51] Int. Cl.[2] ..... E04B 1/00

[52] U.S. Cl. ..... 52/748; 52/521; 52/537; 52/543

[58] Field of Search ..... 52/533, 537, 549, 520, 52/521, 527, 538, 542, 547, 543, 96, 58, 618, 336, 495, 748

[56] References Cited

U.S. PATENT DOCUMENTS

| | | | |
|---|---|---|---|
| 1,179,523 | 4/1916 | Hammond | 52/521 |
| 1,376,751 | 5/1921 | Edwards | 52/520 |
| 2,112,178 | 3/1938 | Selph | 52/537 X |
| 2,124,830 | 7/1938 | Roth | 52/748 X |
| 3,353,313 | 11/1967 | Krysinski | 52/495 X |
| 3,812,636 | 5/1974 | Albrecht et al. | 52/336 X |
| 3,852,933 | 12/1974 | Guzzo | 52/533 |
| 3,898,783 | 8/1975 | Matlock et al. | 52/520 X |
| 3,909,998 | 10/1975 | Simpson et al. | 52/618 X |
| 3,990,206 | 11/1976 | Reusser | 52/521 X |

*Primary Examiner*—Price C. Faw, Jr.
*Assistant Examiner*—Carl D. Friedman

[57] ABSTRACT

A method of covering a structure with a panel assembly, comprises laying on the structure a first panel which has first and second marginal ridge portions and an attachment flange extending from the first marginal ridge portion and fixing the attachment flange of the first panel to the structure by means of a fastener passing through the attachment flange. A second panel having first and second marginal ridge portions is placed in overlapping relationship over the first panel thereby to conceal by means of the second marginal ridge portion of the second panel the fixing of the attachment flange of the first panel to the structure. Fastening means are passed through the overlapping first and second marginal ridge portions at locations spaced from said structure. The overlapping marginal ridge portions are then connected together by using the fastening means.

13 Claims, 18 Drawing Figures

PANEL ASSEMBLIES AND METHODS OF FORMING SAME

CROSS-REFERENCE TO RELATED APPLICATION

This invention relates to a method of covering a structure with a panel assembly, and is a continuation-in-part of co-pending Application Ser. No. 677,984, filed Apr. 19th, 1976.

BACKGROUND OF THE INVENTION

It has been proposed to provide panel assemblies having hidden fastening systems. For example, Guzzo, in U.S. Pat. No. 3,852,933, utilises undulating roof panels with separate clips for holding the panels. The panels are not unitary panels including their own fastening flanges through which fasteners are passed. Furthermore, the panels are not rigidly fixed together but are interlocked by manipulation to prevent accidental separation.

In U.S. Pat. No. 1,376,751, Edwards discloses the use of a roofing cleat to prevent crushing or bending of panels when a nail is driven through the panels. The cleats are thus intended to overcome the disadvantages which arise when fixing panels in a conventional manner, that is by driving nails right through the panels.

It is quite clear that Edwards' roofing system and his various panels are totally unsuited to a hidden fastening system.

Roys in U.S. Pat. No. 95,732 has one panel nailed to a structure and another panel is slid over the fastened panel to secure the two panels together. There is no space between the panels for heads of fasteners other than nails, such as bolt heads. In practice, this structure would apparently be impractical because of the difficulties of sliding one panel over another and a sliding engagement would probably also make it impractical, if not impossible, to include conventional sealants between the ribs. In addition it seems that the ribs could be trodden down relatively easily by people walking on the roofing. This could make subsequent separation of the panels virtually impossible without completely destroying the panels.

Moomaw, Stasch and Johnson in U.S. Pat. Nos. 1,329,794, 841,276 and 3,495,363, provide hidden fastening systems with interlocking panels. In each case, the panels are of a relatively complex shape. Stacking of the panels for transport purposes would clearly be difficult and could readily result in damage to the panels.

Stasch and Moomaw both use nails to fix down their panels and there is no provision for the use of other fasteners, such as bolts. The panels are forced together or manipulated in order to interlock the panels.

Selph, in U.S. Pat. No. 2,112,178, discloses an anchor lock for use in metal roofing having hidden fasteners. Clearly the use of an anchor lock will not ensure that the overlapping ridges are drawn tightly together in practice and cannot prevent excessive free play between the panels. This type of lock would also make it difficult to compress a sealant between the panels.

In Selph's panels, the lugs are pre-attached and the holes are formed in the panels before use and it is readily apparent this would give rise to difficulties in obtaining exact alignment of the panels during assembly. Furthermore, it would make it difficult to stack the sheets without damaging the lugs. In practice, it would probably also be difficult to attach the lugs without causing some damage to the panels themselves.

Once the roofing had been fixed in place, relative movement between Selph's ridges could serve to sever the lugs from the panel.

In Australian Pat. No. 257,361, Handford shows a panel with edge ridges of basically rectangular outline. These ridges are provided with resiliently interlocking portions which hold the ridges together. In FIGS. 2 and 4, a hidden fastener arrangement is used but this is based on a fastening with the attachment zones placed a considerable distance from the structure. In FIGS. 3 and 5, a locating bracket has to be used to attach the ridges to the structure.

In Australian Pat. No. 226,784, Pelman discloses a hidden fastener system which is dependent on a bracket fixed to a structure and hooking over the edge of a lower panel. An upper panel hooks over the bracket by means of lip 17 and is thus located in place. The clips must clearly be accurately pre-located at a spacing which is equal to the distance between the ridges of each panel. There is no provision for ensuring that the upper panel does not separate from the bracket and there is no practical way of locating conventional sealant strips between the panels.

SUMMARY OF THE INVENTION

The present invention provides a method of covering a structure with a panel assembly, which is characterised by:

laying on the structure a first panel which has first and second marginal ridge portions and an attachment flange extending from the first marginal ridge portion;

fixing the attachment flange of the first panel to the structure by means of a fastener passing through the attachment flange;

placing a second panel having first and second marginal ridge portions in overlapping relationship over the first panel thereby to conceal by means of the second marginal ridge portion of the second panel the fixing of the attachment flange of the first panel to the structure;

passing fastening means through the overlapping first and second marginal ridge portions at locations spaced from said structure; and connecting the overlapping marginal ridge portions together by using the fastening means.

During assembly, the attachment zone can lie flat against a structure and be fixed to the structure by fasteners without the need for costly clips or cleats. The attached ridge may have a central strip which can be fixed rigidly to a central strip of an overlapping ridge. The central strips of the panels are connected together by suitable fasteners such as rivets or sheet bolts which serve to draw the strips tightly together to prevent rain passing between the strips and thus into the interior of the building. A sealant can be readily compressed between the central strips by means of the fasteners to further ensure a waterproof seal. The two overlapping marginal ridges may then effectively form a composite ridge which can have downwardly diverging flanks which, because of the substantially rigid fixing, can cause the overlapping ridges to act as a normal unitary ridge. A perpendicular outermost flank can serve to further strengthen the assembly in the region of the overlapping ridges and the panel is therefore not weakened and can be strengthened in the region of the overlapping ridges. This is in complete contrast to many of the prior art specifications.

The applicant's panels can be stacked for transport purposes without damage to the panels. There are no pre-attached elements to be damaged. The holes in the panels can be formed when the panels have been placed on the structure to ensure that they are correctly positioned. Once the attachment zone has been fixed in place by means of fasteners, which is a simple operation because the fasteners are next to the edge of the panel and there is ready access to the top and the bottom of the zone and eg purlins, particularly when using hook bolts, a second panel can be placed in overlapping relationship over the first panel without the need to manipulate the panel or to apply any substantial pressure to the overlapping panel to locate the central strips in position one above another. This is in complete contrast to interlocking systems where the over-lapping panels must be correctly located with respect to one another, must be correctly aligned with one another to ensure alignment of holes and lugs or must be pivoted to enable a hooked formation of one panel to engage in a slot in another panel. The overlapping panel may be located in any desired position in relation to the panel which has already been fixed to the structure and can then be fixed in place, for example, by drilling holes through overlapping central strips, passing fasteners through the holes and then using the fasteners to fix the panels together.

A rigid fastening between the central strips means that the strips will be able to move together when there is expansion or contraction longitudinally of the marginal ridges and the movement can be compensated for at the attachment zone, for example by making the holes for the fasteners slightly oversize, by the use of the spring washers or by the use of hook bolts which pivot slightly where they engage purlins. Limited movement transversely to the ridges can be permitted inter alia by a perpendicular outermost flank adjacent to the attachment zone, and also by the thin wall material and concertina effect of the panel.

The applicant therefore provides for easy fastening of the panels without the need to accurately align the panels or to manipulate the panels unnecessarily, and provides a panel which can be readily and economically mass-produced by a rolling process.

In one embodiment, the marginal ridge portions are shaped to define a cavity intermediate the overlapping marginal ridge portions for receiving part of a fastener fixing the first panel to the structure. For example, an innermost flank of the second marginal portion of the second panel can be inclined with respect to an outermost flank of the first marginal portion of the first panel to define a substantially triangular cavity between itself and the flange and outermost flank of the first marginal portion of the first panel.

Each panel may have at least one ridge separated from the marginal ridge portions by substantially coplanar bands. Each marginal ridge portion may then have a ridge with a pair of flanks extending away from the plane of the bands and converging towards a central strip connecting the flanks, the strips being in a plane substantially parallel to the bands and an outermost flank of the ridge of the first marginal portion being perpendicular to the plane of the bands.

Although the overlapping marginal ridge portions can be connected together by any suitable fasteners it is convenient to fix these ridge portions together by rivets.

The second marginal ridge portion of the second panel may have a first ridge co-operating with the first marginal ridge portion of the first panel and attachable to the first marginal ridge portion to connect the panels together and may also have a second ridge at least partly covering one side of the attachment flange.

Once the panel assembly has been attached to the structure a covering may be provided on at least one side of the panel assembly. The covering may comprise a plurality of panels which are held to the structure or panel assembly by suitable fixing means. The fixing means may include elongate members having flanges against which the panels can rest and may also include channel sections having limbs for locating or supporting the panels. Mullions can be provided for at least partly concealing the fixing means and the structure. If desired, thermal or other insulation may be disposed between the panel assembly and the covering panels.

In one embodiment, the panels of the panel assembly may have at least one central ridge and the marginal ridge portions may include ridges which are substantially smaller than the or each central ridge, in which case, a passage for conduits and communication lines may be formed within the central ridge or ridges.

If the structure comprises horizontal beams and the panels are supported in a substantially horizontal position on the beams, a light weight filler can cover the panel assembly and floor panels can be supported by this filler to provide a light weight floor construction.

In yet another embodiment, each panel may have an outermost flank fast with the attachment flange and being of a height that is substantially greater than the height of any of the ridges. A filler, such as a foamed plastics material, can then fill the ridges and can extend away from the ridges and substantially to the level of the attachment flange.

BRIEF DESCRIPTION OF THE DRAWINGS

Embodiments of the invention will now be described by way of example, with reference to the accompanying drawings, in which.

DESCRIPTION OF PREFERRED EMBODIMENTS

Figure 1:
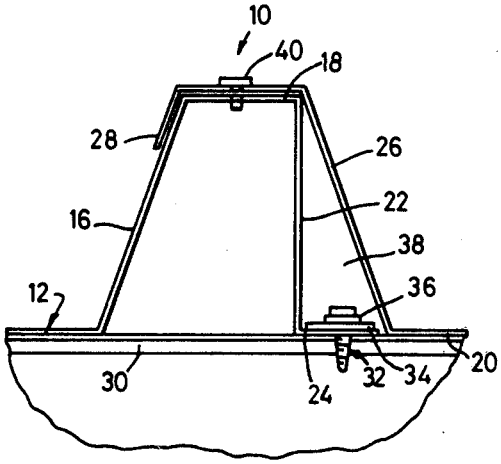
FIG. 1 is a partial cross-section through a part of a building.

The panel assembly 10 shown in FIG. 1 comprises a plurality of building panels 12. Each of the panels has a plurality of substantially parallel, elongate ridges 14 including marginal ridges 14.1 and 14.2 at opposite edges thereof. Each of the ridges has flanks 16 which converge towards one another and which are connected together at their closest edges by connecting strips 18. The ridges are connected to one another by parallel bands 20. The bands 20 are substantially co-planar and the strips 18 are located in planes substantially parallel to the plane of the bands.

Each of the marginal ridges 14.1 has an outermost flank 22, that is outermost with respect to the panel of which it forms part, and this flank is at right angles to the plane of the bands 20. A flange 24 extends along the edge of the flank 22 that is spaced from the adjacent connecting strip 18.

The marginal flange 14.2 at the opposite end of each panel has an inclined innermost flank 26 at its side nearest to the other marginal ridge 14.1 of the panel, and has a shortened flank 28 forming the outer edge of the panel.

To mount the panel assembly on a building structure, for example as a roof, a single panel is mounted on the structure with the bands 20 and flange 24 lying against part of the structure. Holes are made in the flange and are aligned with holes made, for example, in purlins 30 of the structure. Fastener 32 such as a selftapping screw is screwed through the flange into the purlin, a flat washer 34 and a spring washer 36 being located between the flange and the head of the fastener 32. Instead of using screws, a hole may be provided in the flange 24 next to the purlin 30 and the flange may be attached to the purlin by a hook bolt hooking over the purlin. Rivets may also be used as connectors.

A second panel is then laid on the structure next to the first panel with the marginal ridge 14.2 thereof overlapping and receiving part of the marginal portion 14.1 of the panel already attached to the structure. Because of the different shapes of the marginal ridges, a cavity 38 is formed between the outermost flank 22 of the ridge 14.1 and the inner flank 26 of the ridge 14.2. The head of the fastener 32 is received in this cavity. The adjacent band 20 of the second panel lies flat against the purlin 30 next to the flange 24 as shown in FIG. 1. The overlapping strips 18 of the two panels are fixed together by rivets 40 or sheet bolts and washers and the overlapping engagement of the two ridges ensures that rain cannot pass between the two panels.

Further panels are mounted on the building structure by connecting their flanges 24 to the structure and then connecting the marginal ridges 14.1 and 14.2 of adjacent panels together in the manner described and illustrated.

Figure 4:
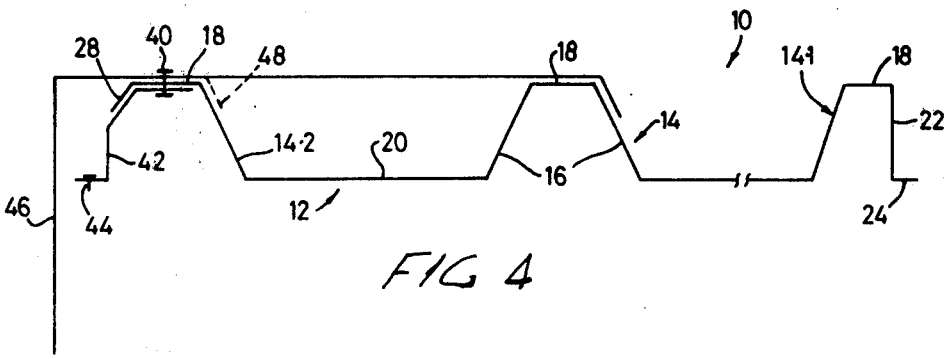
FIG. 4 shows an edge portion of the assembly including a gable trim.

At one edge of the panel assembly there will be a flange 24 that is not covered by an adjacent panel and at the other end of the panel assembly there will be a marginal ridge 14.2 that is not connected to the structure by an adjacent marginal ridge 14.1. The free marginal ridge 14.2 is therefore connected to the structure by a connecting element 42 having the cross-section shown in FIG. 4, the connecting element being fixed to the building structure (not shown) by a connector or fastener 44.

A gable trim 46 overlaps the two ridges adjacent to the outside edge of the panel assembly and is fixed to the adjacent marginal ridge by rivets 40. It is also connected to the connecting element 42 associated with the ridge 14.2 by these rivets. If desired the gable trim 46 may overlap only a single ridge of the panel in which case it is shortened and terminates at the location indicated in chain lines at 48.

A sealant may be provided between the connecting strips 18 of adjacent panels and between the strips 18 and gable trim 46 to make the covering completely water tight.

Because the flanges 24 to be attached to the building structure are at the edge of each panel, workmen attaching the panel may easily see where they make the holes for fasteners. Furthermore, because the heads of the fasteners 32 are completely enclosed, there is no need to use sealing washers. Furthermore, ready access to the fasteners 32 is prevented. This makes it considerably more difficult for thieves to remove the covering to obtain access to the building.

The panels 12 are each made as a unitary panel and may be made of mild steel, stainless steel, copper, aluminium, asbestos, fibreglass or other suitable material.

Figure 5:
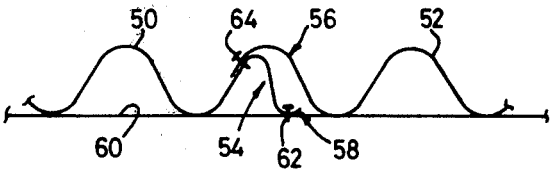
FIG. 5 shows part of another building.

In FIG. 5, two alternative, generally sinusoidal panels 50 and 52 are shown having first and second marginal ridges 54 and 65 in overlapping relationship. The marginal ridges have different cross-sections, an attachment zone 58 of the ridge 50 being attached to a building structure 60 by a fastener 62. The second marginal ridge 56 overlaps the first ridge 54 and is attached to it by another fastener 64. The second ridge 56 conceals and covers the fastener 62 attaching the first marginal ridge 54 to the building structure 60.

Figure 6:
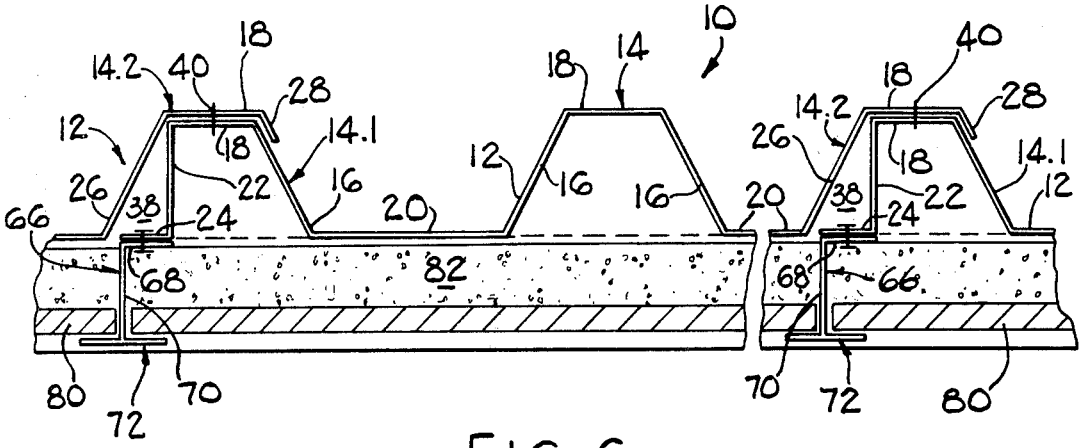
FIG. 6 is a partial cross-section through a part of a building.
Figure 7:
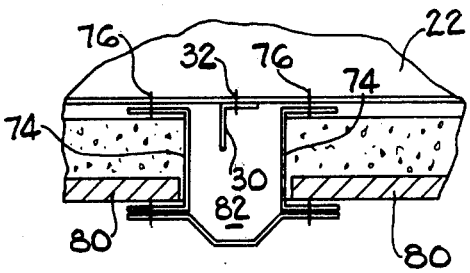
FIG. 7 is a cross-section through a part of the building at right angles to FIG. 6.

FIGS. 6 and 7 incorporate a panel assembly which is substantially identical to that of FIGS. 1 to 4.

In FIGS. 6 and 7, elongate members 66 at right angles to the purlins 30 are secured to the flanges 24 at intervals along their lengths. More specifically, the members 66 each have a bead 68 which is of substantially the same width as an associated flange 24 and is fixed to the flange along its length. A web 70 of each member 66 extends from the bead 68 to a bottom piece 72. The bottom piece 72 forms two support flanges projecting away from opposite sides of the web 70.

The head 68 and flange 66 can be fixed together by any suitable fasteners, such as by rivets or by staples to form a row of metal 'stitching' holding the flange and bead together.

The members 66 could be replaced by inverted T-shaped members, in which case the beads 68 would be eliminated and the heights of the webs 70 would be increased to enable the webs 70 to be attached directly to the flanks 22.

Figure 2:
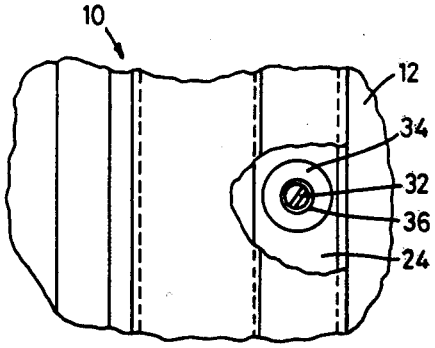
FIG. 2 is a partially cut away plan view of the part of the building shown in FIG. 1.

Channel sections 74 or channel-type brackets extend alongside the purlins and are fixed to the flanges 24 on opposite sides of the purlin by rivets 76 or other suitable fasteners. The channels face away from one another as shown in FIG. 2. The members 66 extend substantially up to the purlins between the ends of channel sections 74, and mullions 78 are fixed to the channel sections 74 by rivets, for example, to hide the purlins 30 and also to hide the locations where the members 66 pass between channel sections 74.

Ceiling panels 80 are supported by the support flanges of the members 66 and by the lower limbs of the channel sections 74. Insulating material 82 is located between the panels 80 and the panels 12, and also between the channel sections 74 above the mullions 78.

The sections 74 and panels 80 may be connected to the panels 12 between the flanges 24 to strengthen the structure if required.

Figure 3:
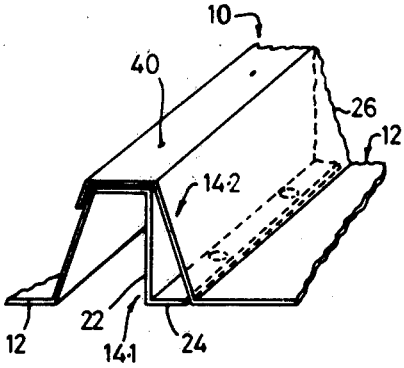
FIG. 3 is a three-dimensional view of part of a panel assembly covering part of the building.
Figure 8:
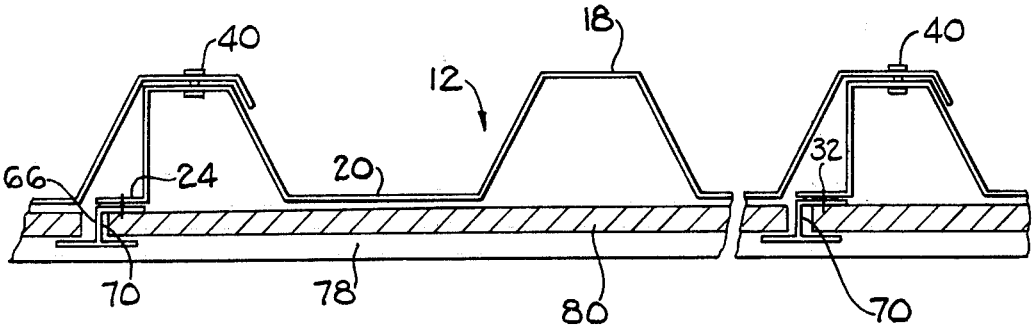
FIG. 8 is a cross-section through part of an alternative building.

FIG. 8 shows a part of a building similar to that of FIG. 6 but without the insulating material 82. This means that the webs 70 of the members 66 need not be as high as those of FIG. 6, and also means that channel sections and mullions like those of FIG. 7 need not extend so far from the panels 12. The channel sections used in the building of FIG. 3 are not shown.

The ceiling panels may be attached directly to flanges 24 of the roof panels 12 by suitable fasteners (not shown) at various spaced locations and this enables larger panels to be used, reducing the number of members 66 and channel sections 74 for a particular ceiling area, or even eliminating the need for these members and sections.

Although the members 66 are shown extending parallel to the flanges 24, they may run transversely to these flanges. They can again be connected to the flanges.

Figure 9:
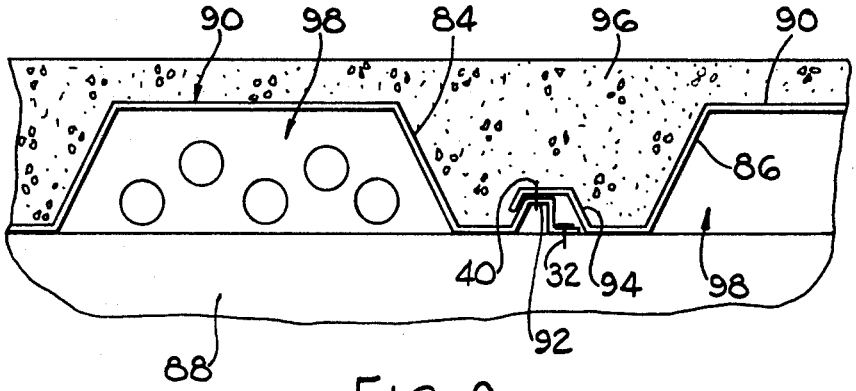
FIG. 9 illustrates part of a floor structure.

In FIG. 9, overlapping parts of two panels 84, 86 are shown supported by a concrete beam 88, although the panels may be supported by any suitable beams or walls.

Each panel has a main, central ridge 90 and relatively small marginal ridges 92 and 94. The ridges 92 and 94 are identical to the ridges 14.1 and 14.2 of FIGS. 1 to 4 and are fixed together and to the beam in any desired manner. A concrete floor 96 is cast in situ on the panels and forms a covering for the panels. The concrete floor can include any suitable reinforcing, such as weldmesh or reinforcing rods. A ceiling may be suspended below the panels if required. The main ridges 90 define passages 98 through which conduits, communication lines and air ducts can pass.

Instead of having the concrete covering on the panels, the panels may be covered with a light weight filler, such as vermiculite. The filler can then support suitable floor panels to provide a light weight floor construction.

Figure 10:
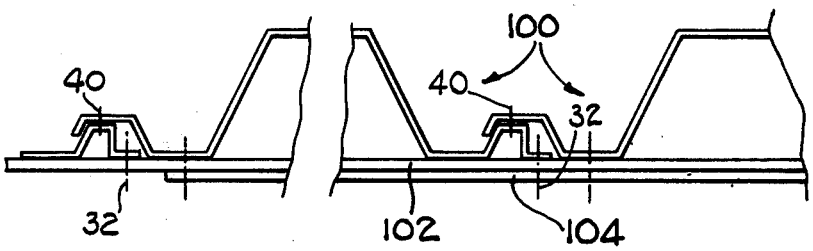
FIG. 10 is a cross-section through part of a wall.

FIG. 10 shows part of a wall having cladding with external panels 100 which are similar to the panels 84 and 86 in FIG. 9. However, these panels are vertical and are fixed to beams 102. A covering 104 is attached to the beams 102 or to the external panels 100 to provide an inner surface of the wall. Mullions, similar to those in FIG. 7, may be used to cover the joints between the panels. Conduits, communication lines or the like may pass through passages formed within the wall.

As the wall cladding is to be exposed, its main ridge can be shaped aesthetically, for example by being suitably curved across its width or by being provided with ribs or patterns.

Whenever mullions are used, they may be attached to flanges of support members, channel sections or beams or the like by any suitable screws, bolts, clips, brackets or other fasteners. A suitable packer may then be located between the mullions and flanges to provide fire resistance or to improve sound proofing. The fasteners are chosen accordingly.

Figure 11:
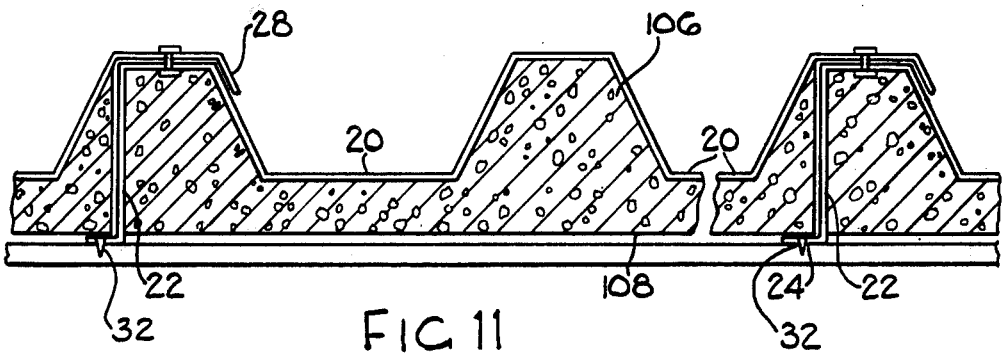
FIG. 11 is a cross-section through part of a panel assembly.

In FIG. 11, each panel 12 is basically similar to the panels of FIGS. 1 to 3 but the flanks 22 have been extended for some distance beyond the level of the bands 20. A block 106 of foamed filler, such as polyurethane foam, fills the ridges 14 and extends to a surface 108 which is parallel to the bands 20 and substantially level with the flanges 24. The flanges 24 can be fixed to any suitable beam, joist or column.

In this Figure, the flanks 28 of the ridges 14.2 overlap the marginal ridges 14.1. The panels are connected together by rivets 40 passing through the strips 18. Instead of the rivets 40, other forms of fasteners, such as sheet bolts may be provided.

Figure 12:
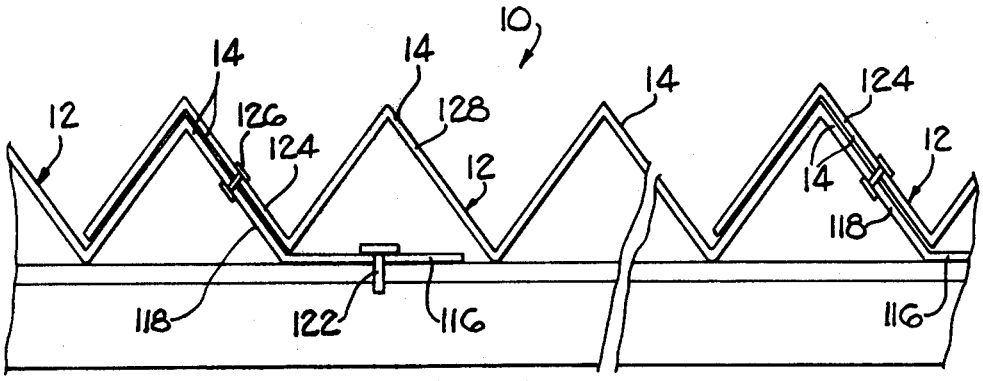
FIGS. 12 to 18 show alternative panel assemblies.
Figure 13:
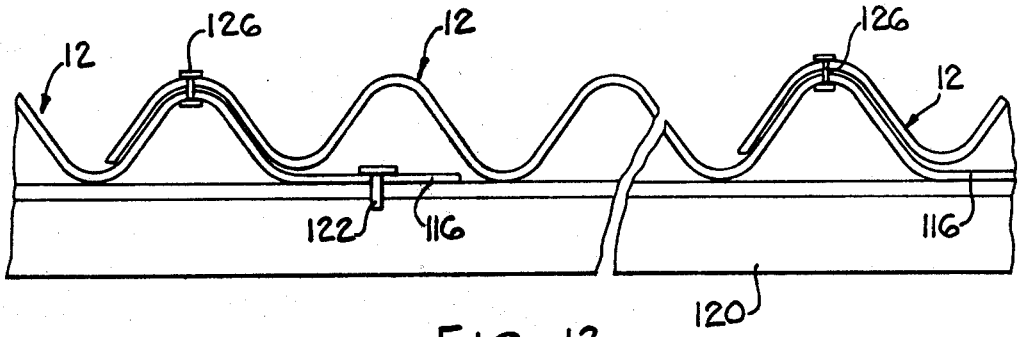
Figure 14:
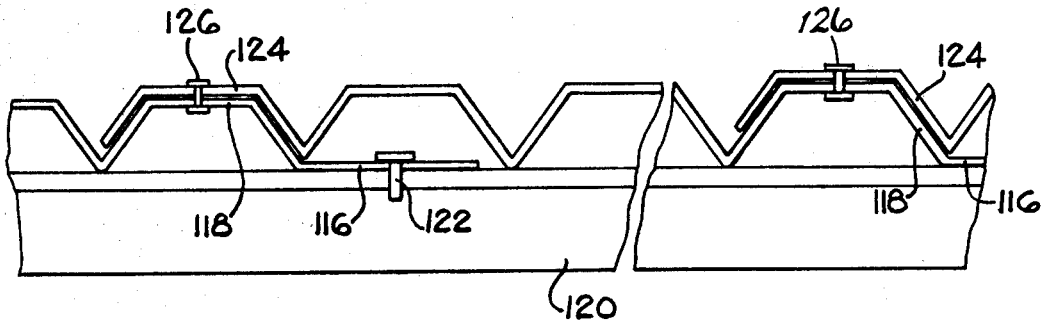

Referring now to each of FIGS. 12 to 14, a panel assembly 10, comprises a plurality of panels 12 each having a plurality of parallel ridges 14 extending along its length. An attachment zone 116 is provided at one edge of a first marginal ridge 118 of each panel.

As can be seen in the drawings, the ridges 14 of the panels in each Figure are all of the same basic outline.

Each panel assembly is attached to part of a building structure, such as a beam, rafter or purlin 120. To attach the covering to the part 120 of the building structure, a first panel is laid so that its attachment zone 116 is lying against the part 120. The zone 116 is then attached to the part 120 by a suitable fastener 122. Once this has been done, a second panel is laid in overlapping relationship with the first panel so that a second marginal ridge 124 of the second panel sits on and co-operates with the first marginal ridge 118 of the first panel. The ridges 118 and 124 are then fixed together by rivets or other suitable fasteners 126. A third ridge 128 of the second panel then covers at least part of the upper surface of the attachment zone 116, which may be a strip extending along the whole length of the first panel.

A waterproof membrane may be applied to the external surface of the panel assembly and may provide the assembly with a decorative finish.

Whereas the ridges 14 of FIG. 12 are generally triangular, FIG. 13 has ridges which are of a generally sinusoidal configuration. However, the assemblies are of the same basic form. FIG. 14 illustrates a further shape of panel ridge.

Figure 15:
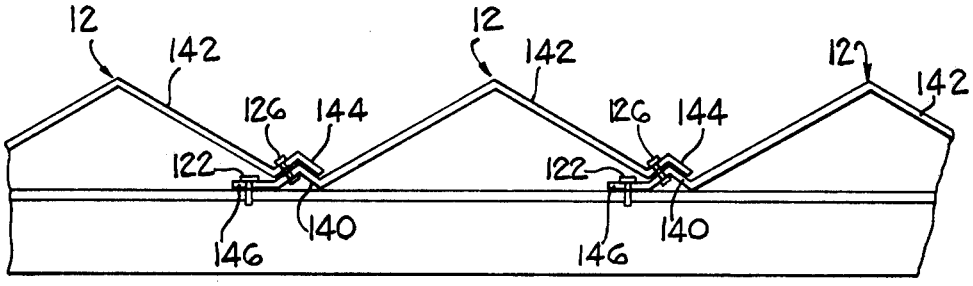
Figure 16:
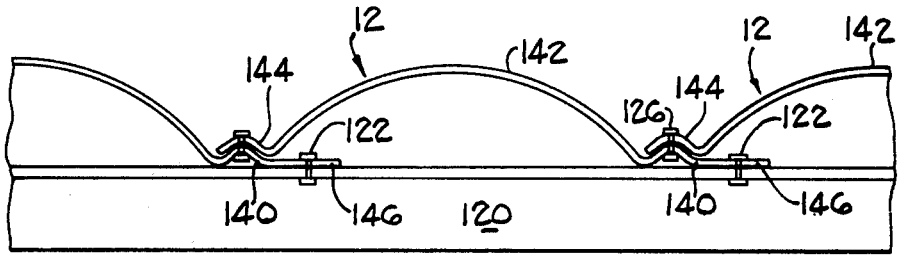
Figure 17:
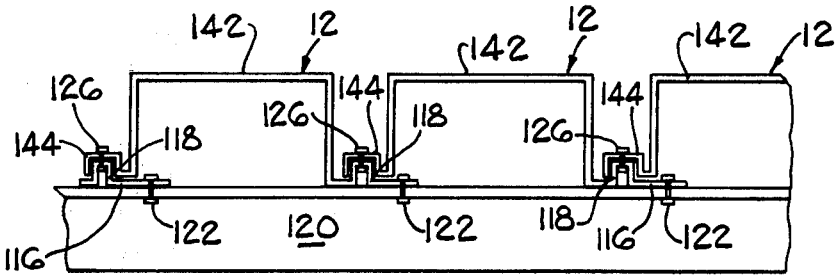

FIGS. 15, 16 and 17 show panel assemblies including panels 12 which have first marginal ridges 140, main ridges 142, and second marginal ridges 144 co-operating with the first marginal ridges 140. Attachment zones 146 extend along all or substantially all of the length of the ridges 140.

The zones 146 are connected to parts 120 of building structures by fasteners 122 and the first and second marginal ridges are connected together by fasteners 126 and additionally or alternatively by adhesive. The main ridges of these panels may each be about half a metre wide or more and may provide a decorative exterior to a building or may alternatively be used for structural purposes, for example in flooring constructions. When used in flooring constructions, the panel assemblies can be covered with concrete or a lightweight filler, such as vermiculite, which can then support suitable floor panels to provide the floor construction. Conduits communication lines or the like may pass through the space within the main ridges 142.

Figure 18:
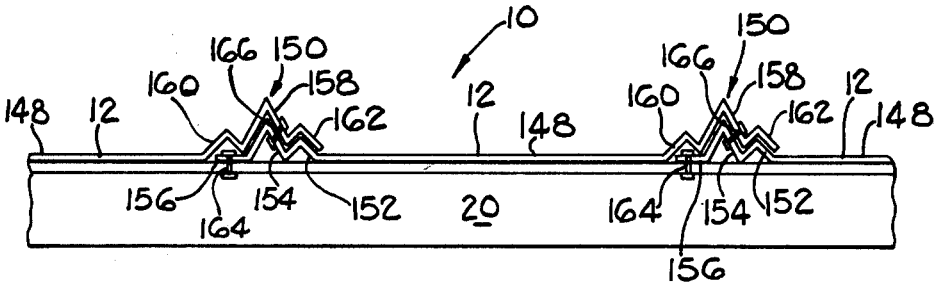

In FIG. 18, a panel assembly 10 again comprises a plurality of panels 12. However, these panels have a flat central portion 148 and ridged portions 150 at their edges. As can be seen in the Figure, each panel has a minor ridge 152 and a first marginal ridge 154 with an attachment ridge 156 at one of its edges; and has a central ridge 158 disposed between a ridge 160 and a marginal ridge 162 at its other edge. The attachment zone 156 of each panel is attached to a part 120 of a building structure by suitable fasteners 164 and the ridges 154 and 158 are connected together by suitable fasteners 166. The fasteners 166 may be rivets. The attachment zone 156 is at least partly covered by the ridge 160 of the overlapping panel and this ridge prevents the attachment zone from being seen from the exterior of the panel. A sealant or an adhesive may be disposed between the overlapping ridges of the panels. As with the other coverings, this panel assembly may be coated with a waterproof membrane, which may provide a decorative finish.

What I claim is:

1. A method of covering a structure with a panel assembly comprising:

providing a supporting structure including at least one structural support member;

laying on one side of the supporting structure a first panel which has first and second marginal ridge portions on the opposed extremities thereof and an attachment flange extending from the first marginal ridge portion;

securing the attachment flange of the first panel to said one side of said supporting structure by means of a fastener passing through the attachment flange;

placing a second panel having first and second marginal ridge portions on the opposed extremities thereof in overlapping relationship over the first panel thereby to conceal by means of the second marginal ridge portion of the second panel the securing of the attachment flange of the first panel to said supporting structure;

passing fastening means through the overlapping first and second marginal ridge portions at locations spaced from said supporting structure and securing said first and second panels against relative movement by means of said fastening means;

providing fixing means depending below said supporting structure and presenting horizontal support surfaces on the side thereof opposite to said one side;

and positioning a covering comprising a plurality of panels in supporting relation on said horizontal support surfaces.

2. A method according to claim 1, including forming a cavity intermediate the overlapping marginal ridge portions for receiving part of a fastener fixing the first panel to the structure.

3. A method according to claim 2, including inclining an innermost flank of the second marginal portion of the second panel with respect to an outermost flank of the first marginal portion of the first panel to define a substantially triangular cavity between itself and the flange and outermost flank of the first marginal portion of the first panel.

4. A method according to claim 1, including providing each panel with at least one ridge separated from the marginal ridge portions by substantially co-planar bands and each marginal ridge portion with a ridge having a pair of flanks converging towards a central strip connecting the flanks, locating the strips in a plane substantially parallel to the bands and locating an outermost flank of the ridge of the first marginal portion perpendicular to the plane of the bands.

5. A method according to claim 1, including connecting the overlapping marginal ridge portions together by rivets.

6. A method according to claim 1, wherein a second panel is used having first and second ridges, locating the said first ridge located in the second marginal ridge portion of the second panel over the first marginal ridge portion of the first panel and attaching it to the first marginal ridge portion to connect the panels together and also locating the second ridge located adjacent the said second marginal ridge portion at least partly over one side of the attachment flange.

7. A method according to claim 1, comprising positioning the covering after the panel assembly has been attached to the supporting structure.

8. A method according to claim 7, wherein the covering comprises a plurality of panels, fixing the panels to the structure by suitable fixing means.

9. A method according to claim 8, including providing fixing means which includes elongate members having horizontally extending flanges for supporting the panels and channel sections having limbs for locating or supporting the panels.

10. A method according to claim 9, including providing mullions for at least partly concealing the fixing means and the supporting structure.

11. A method according to claim 1, including disposing thermal insulation between the panel assembly and the covering.

12. A panel assembly comprising at least two panels each having first and second opposed elongate marginal ridges, the first marginal ridge of each panel including first and second vertically extending flanks which converge upwardly towards each other and are joined at their upper edges by a connecting strip, one of said flanks at the lower edge thereof having an attachment zone extending horizontally therefrom whereby the panel may be attached to a supporting structure by at least one fastening means, the second marginal ridge of each panel being of different cross-section but partly complementary to the first marginal ridge thereof, adjacent panels thus being assembled by placing of the second marginal ridge of one of said adjacent panels in overlapping relationship over the first marginal ridge of the second of said adjacent panels to cover the attachment zone thereof, the said overlapping second marginal ridge having first and second vertically extending flanks which converge upwardly towards each other and are joined at their upper edges by a second connecting strip, the flanks and connecting strip of each said second overlapping marginal ridge being cooperable with the underlying first marginal ridge of the adjacent panel which it overlaps, one of the flanks of the overlying second marginal ridge extending over the attachment zone of the underlying first marginal ridge to define a cavity within which is received the fastening means securing the attachment zone to the supporting structure, and the said first and second overlapping marginal ridges of adjacent panels being fixed together by fastening means passing through the connecting strips thereof, said first and second overlapping marginal ridges being thus restrained against lateral movement with respect to one another during erection of the panel assembly.

13. An assembly according to claim 12, wherein the fastening means passing through said connecting strips are rivets, said rivets being otherwise unconnected to the supporting structure.

* * * * *